US008605021B2

(12) United States Patent
Speirs

(10) Patent No.: US 8,605,021 B2
(45) Date of Patent: Dec. 10, 2013

(54) DISPLAY DEVICE WITH CHARGE SHARING

(75) Inventor: Christopher Rodd Speirs, Zürich (CH)

(73) Assignee: Entropic Communications, Inc., San Diego, CA (US)

( * ) Notice: Subject to any disclaimer, the term of this patent is extended or adjusted under 35 U.S.C. 154(b) by 634 days.

(21) Appl. No.: 10/532,254

(22) PCT Filed: Oct. 17, 2003

(86) PCT No.: PCT/IB03/04577
§ 371 (c)(1),
(2), (4) Date: Apr. 21, 2005

(87) PCT Pub. No.: WO2004/038688
PCT Pub. Date: May 6, 2004

(65) Prior Publication Data

US 2006/0038801 A1 Feb. 23, 2006

(30) Foreign Application Priority Data

Oct. 25, 2002 (EP) ..... 02102490

(51) Int. Cl.
*G09G 3/36* (2006.01)

(52) U.S. Cl.
USPC ..... 345/94; 345/92; 345/53

(58) Field of Classification Search
USPC ..... 345/204, 210, 94–95, 92, 87, 53, 96
See application file for complete search history.

(56) References Cited

U.S. PATENT DOCUMENTS

| | | | | |
|---|---|---|---|---|
| 4,818,981 | A | 4/1989 | Oki et al. | |
| 5,821,923 | A | 10/1998 | Van Amesfoort | |
| 5,852,426 | A * | 12/1998 | Erhart et al. | 345/211 |
| 5,907,314 | A * | 5/1999 | Negishi et al. | 345/103 |
| 6,300,930 | B1 | 10/2001 | Mori | |
| 6,417,830 | B1 | 7/2002 | Byeon, II | |
| 6,538,629 | B1 * | 3/2003 | Ito | 345/94 |
| 6,642,916 | B1 | 11/2003 | Kodama | |

(Continued)

FOREIGN PATENT DOCUMENTS

| | | |
|---|---|---|
| CN | 1224180 A | 7/1999 |
| GB | 2 326 013 | 12/1998 |

(Continued)

*Primary Examiner* — Kevin M Nguyen
(74) *Attorney, Agent, or Firm* — Bruce Greenhaus; Richard Bachand; Duane Morris LLP

(57) ABSTRACT

The invention relates to a display device and to a method of controlling a display device. A display device with a plurality of pixels arranged in rows n and columns m is presented so as to render possible an energy saving through charge sharing in the display device, in particular an active matrix display, in which the pixels can be activated via control lines (6), and with a row driver circuit (4) for driving the n rows with a row voltage ($V_{row}$), wherein the rows of the display device can be consecutively selected from 1 to n, and with a column driver circuit (3) for driving the m columns with a column voltage ($V_{col}$) corresponding to the picture data of the pixels (8) of the selected line to be displayed, and wherein it is provided for a transition from a selected row n to another row n+1 that the row voltage ($V_{row}$) is connected to an intermediate voltage level ($V_Z$), and the row n+1 is first connected to the intermediate voltage level ($V_Z$) and subsequently is charged up to the required row voltage ($V_{row}$).

8 Claims, 2 Drawing Sheets

(56) References Cited

U.S. PATENT DOCUMENTS

| | | | | |
|---|---|---|---|---|
| 6,717,563 | B2 * | 4/2004 | Kim | 345/96 |
| 6,727,878 | B2 * | 4/2004 | Okuzono et al. | 345/94 |
| 2001/0043178 | A1 * | 11/2001 | Okuzono et al. | 345/87 |
| 2002/0057245 | A1 * | 5/2002 | Yanagi et al. | 345/87 |
| 2002/0109653 | A1 | 8/2002 | Kudo | |
| 2002/0126083 | A1 * | 9/2002 | Cairns et al. | 345/98 |

FOREIGN PATENT DOCUMENTS

| | | | |
|---|---|---|---|
| JP | 09-258170 | | 10/1997 |
| JP | 11-30975 | | 2/1999 |
| JP | 11-305711 | | 11/1999 |
| JP | 2002-244622 | | 8/2002 |
| JP | 2004-061972 | | 2/2004 |
| WO | WO01/54108 | * | 7/2001 |
| WO | WO 0154108 | | 7/2001 |

* cited by examiner

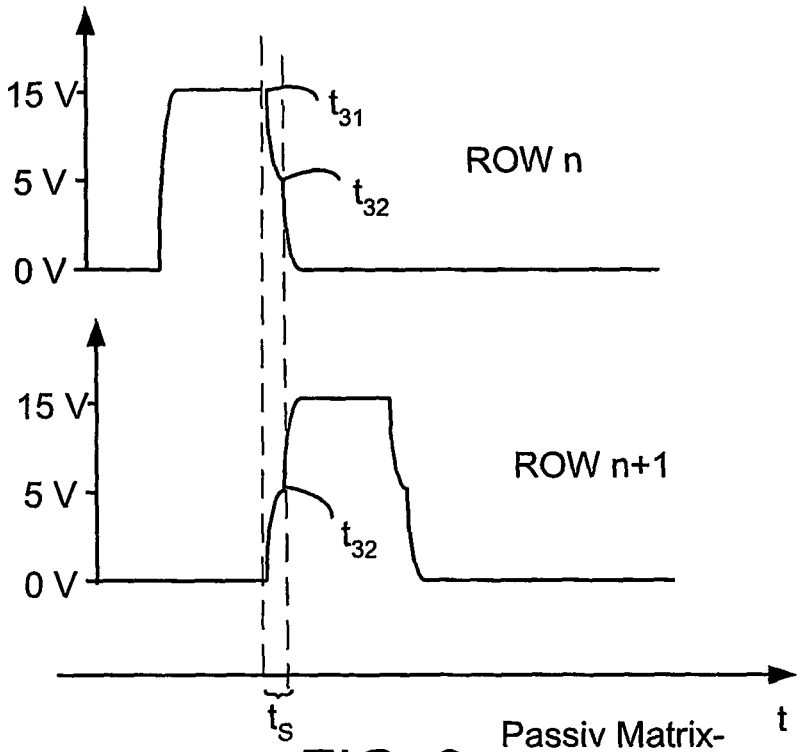
FIG. 3 Passiv Matrix-Display
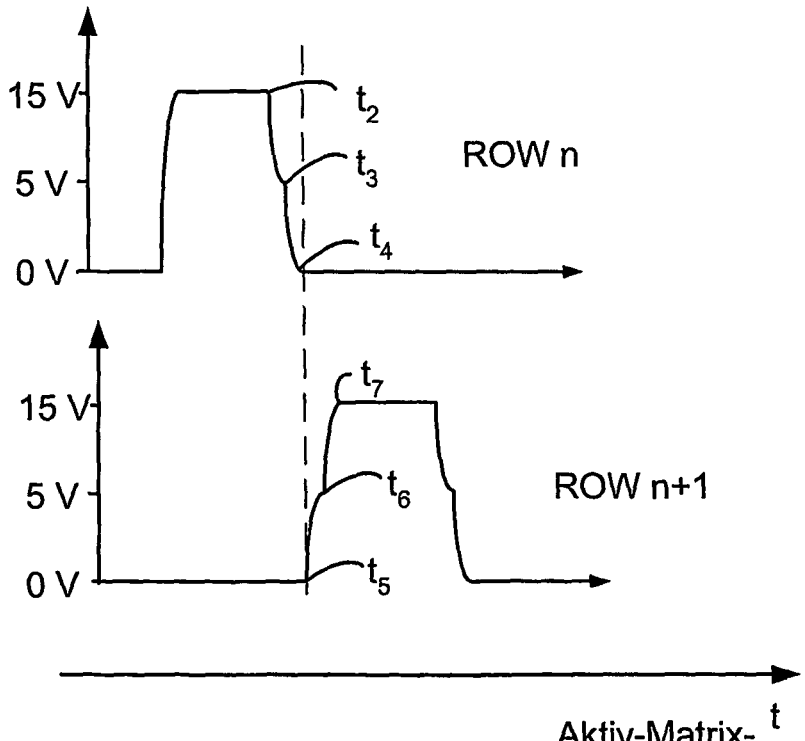
FIG. 4 Aktiv-Matrix-Display

DISPLAY DEVICE WITH CHARGE SHARING

The invention relates to a display device and to a method of controlling a display device.

Display technology plays an increasingly important part in information and communication technology. As the interface between man and the digital world, a display device or display for short has a central significance for the acceptance of modern information systems. Displays are used in particular in portable appliances such as, for example, notebooks, telephones, digital cameras, and personal digital assistants. The energy consumption is a particularly important criterion in these portable appliances, because the operational life of the battery of the appliance, and thus the period of use of the appliance depend thereon.

There are two kinds of displays in principle. These are passive matrix displays on the one hand, and active matrix displays on the other.

The active matrix displays have become particularly important by now because fast picture changes, for example the display of moving images, can be realized by means of this technology. The picture elements or pixels are actively controlled in active matrix LCD technology. The most frequently used version thereof operates with thin-film transistors (TFT-LCD). The image signals in the pixel are indicated here by means of silicon transistors which are directly integrated with each pixel. It is necessary for the display of distinct grey levels that the displays or picture screens can be controlled with correspondingly different voltages from a wide voltage range. Driver circuits with charge pumps are used for this control of the display. Since the integrated circuits, in particular those in portable devices, are fed with a low supply voltage provided by a battery, the higher voltages necessary for controlling the display are to be generated by charge pumps. The rotation of the liquid crystals changes in dependence on the voltage level, so that more or less light is transmitted. This light originates either from a light source arranged behind the display, which radiates a so-called backlight, or from daylight incident from the front on a reflector layer and reflected back, in the case of a reflecting display.

Liquid crystal displays typically are formed from a glass with connection terminals passed to the exterior, to which the driver circuits or control devices are connected. These driver circuits convert the image signals or image data, which are to be displayed on a display, into the corresponding voltage values. The image information is stored in memory devices in the form of digital image signals or image data. These digital image signals are to be converted into analog signals so that a suitable luminous intensity can be generated on a display by means of an analog voltage. The digital-to-analog converters necessary for this conversion convert the digital image signals into voltages which lie in a range from below 20 mV up to more than 15 V. Since these high voltages are to be generated in the portable appliances by means of charge pumps or charge multipliers, it is particularly important that the available voltage should be utilized as effectively as possible.

It is accordingly an object of the invention to provide a display device in which the energy consumption is reduced through charge sharing.

This object is achieved by means of a display device with a plurality of pixels arrnged in rows n and columns m, wherein the pixels of a row can be selected through control lines, and with a row driver circuit for activating the n rows by means of a row voltage and with a column driver circuit for controlling the m columns with a column voltage, which voltages correspond to the image data of the pixels of the selected row to be displayed, and wherein it is provided upon a transition from a selected row n to another row n+x that the row voltage is connected to an intermediate voltage level and the row n+x is first connected to said intermediate voltage level and subsequently is charged up to the required row voltage.

It is possible in the case of passive matrix displays to utilize the charge or voltage applied to a row jointly with the next row through a connection thereto, and thus to divide or share this charge or voltage. Such an interconnection of the rows or joint utilization of the charge is not possible in the case of active matrix displays, because then both rows would be active simultaneously in part, which would lead to a voltage loss between these rows, so that there would be crosstalk between the rows and the quality of the display would be impaired by this crosstalk between the rows. Two adjoining rows would be simultaneously activated then, and the column voltage applied would switch on the pixels of both rows in the relevant column. Since the column voltage is only provided for a single pixel in accordance with the its grey level, this column voltage would now be applied to two pixels, which the result that pixels would not have the desired grey level.

A direct take-over of the method from the passive matrix displays for a power saving by means of charge sharing is not possible, because the time sequence in the control of passive matrix displays is a different one, and also the voltages for the row and column control are different. As was described above, a direct interconnection leads to a quality reduction of the display device. It is accordingly required in particular to achieve a charge sharing without a noticeable delay in time. On the other hand, the additional expenditure on circuitry for realizing the charge sharing should be kept within bounds.

The rows of an active matrix display are controlled sequentially with predetermined row voltages. The gates of the TFT transistors in the respective row are activated by the row voltage, whereby the row is selected. The pixels (or picture elements) of the selected row are then switched on by the column voltages ($V_{Col}$) applied to the respective data lines of the display, in dependence on the applied column voltage. This column voltage is transferred via the TFT transistor into a storage capacitor present in the pixel, which capacitor keeps the respective voltage or charge in store up to the next line sweep. The column voltages are of different values, the level of the column voltage depending on the grey level to be displayed. The liquid crystals in the pixels rotate to different degrees owing to the different column voltages on the respective data lines, so that more or less light can pass through in dependence on the rotation, which results in a different grey value for the viewer. Color filters are used for the display of colors. A display with several different colors utilizes several TFT transistors integrated in one pixel and several color filters arranged in front of the display. The TFT transistors of a pixel are then switched on jointly or singly in dependence on the color to be displayed.

In the construction according to the invention, the row voltage applied to the row selected at a given moment is first connected to an intermediate voltage level at the transition from the respective row to the next one or to some other row, so that the charge of the selected row can drain off to this intermediate voltage level, at which it is temporarily stored by a capacitor. After the connection to the intermediate voltage level, the remaining charge or voltage of the row is drained off through connection to a reference potential. The row to be newly selected cannot be connected to the intermediate voltage level until after the moment at which the selected row was separated from the intermediate voltage level.

During charging-up of the row voltage for activating the next row, this row is first connected to the intermediate voltage level, so that the charge stored there in the capacitor can flow to this row. It is only necessary after that to charge the respective row from the intermediate voltage level up to the finally required row voltage ($V_{Row}$), with the result that less energy need be used for this than if this row were to be charged to the required row voltage starting from the reference potential ($V_0$).

In an advantageous embodiment of the invention, the activated row is connected to an intermediate voltage level present in the driver circuit. In particular, the maximum column voltage $V_{colmax}$ is used as the intermediate voltage level here. It is advantageous in this embodiment that the intermediate voltage level has already been realized in the circuitry technology. As a result, the charge of the selected row flows to this voltage level of approximately 5 V and is thus stored. The next row will then first be connected to this intermediate voltage level $V_{colmax}$ again, so that the row is charged to the $V_{colmax}$ voltage level. The next row is then charged from 5 V to the required 15 to 20 V of the row voltage so as to activate this row. As a result, the row voltage need not be generated to its total level, or by means of a charge pump.

In an advantageous embodiment of the invention, several intermediate voltage levels are used for charge division or sharing. In this case, the charge of the selected row is first connected to the highest intermediate voltage level, followed by the next lower intermediate voltage level. After the selected row has been discharged, the next row is successively connected to the intermediate voltage levels, thus obtaining the charges stored at these levels.

A switching unit is provided for the connection to the one or several intermediate voltage level or levels, to which unit the available voltage levels ($V_{Row}$, $V_{colmax}$) of the display device are supplied. The row voltage applied to the current row n is connected to the intermediate voltage level in this switching unit, for example by means of a transistor acting as a switch.

As the number of intermediate voltage levels increases, however, the circuitry expenditure will become higher than in the case of only a single intermediate voltage level.

The additional time required for switching the currently selected row to the intermediate voltage level and then switching the next row to be controlled to the intermediate voltage level and subsequently to the required row voltage lies in the millisecond range and has no appreciable influence on the quality of the display device.

In an advantageous embodiment of the invention, the inventive construction of the charge sharing mechanism is switched off in the case of a maximum image repetition rate.

Display devices usually have a programmable image repetition rate. This can be selected in dependence on the application. Thus, for example, a higher image repetition rate is required for the display of moving images than in the case of still images, for example on mobile telephones or non-animated displays on computers, for example laptops. The charge sharing according to the invention is accordingly activated only for the display of still images, so that a considerable energy saving can be achieved in this case because of the charge sharing. Time can be saved in a row sweep in the display of moving images thanks to the switching-off possibility of the charge sharing. It is thus possible to choose between a high image repetition rate for movements with a higher energy consumption and a somewhat reduced image repetition rate with a reduced energy consumption.

The object is also achieved by means of a method of controlling a display device with pixels arranged in rows n and columns m, wherein row voltages V1 to V4 are supplied to the rows via control lines so as to select a row, and wherein column voltages are supplied to the columns m via data lines, and wherein the rows are consecutively selected, and in the case of a transition from a selected row n to another row n+1 the charge applied to the selected row is transferred to an intermediate voltage level, and the other row n+1 is first connected to said intermediate voltage level and is subsequently charged up to the required control voltage.

The invention will now be explained in more detail with reference to embodiments shown in the drawings, in which:

FIG. 3 shows row voltages for charge sharing in passive matrix displays, and FIG. 4 shows row voltages for charge sharing in active matrix displays.

FIG. 1 is a block diagram representing the control of a display device 2.

Figure 1:
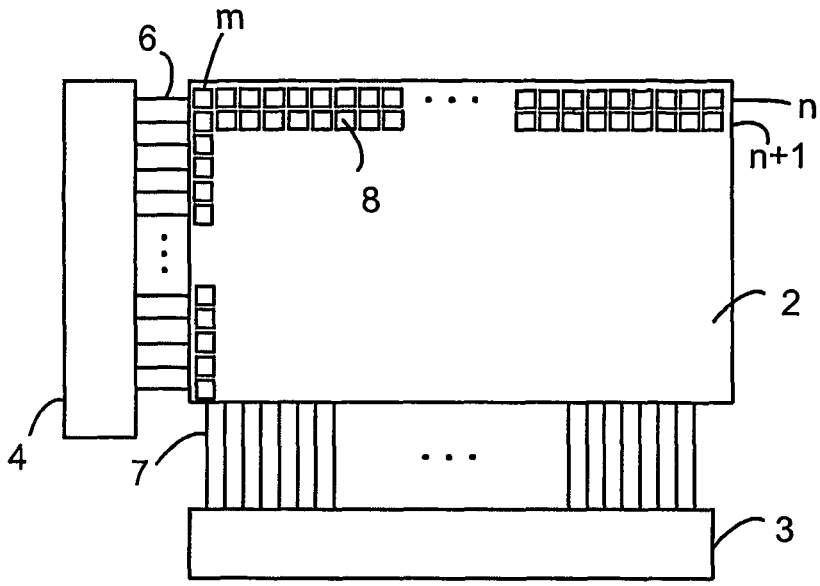
FIG. 1 shows the construction of a display device.

A column driver circuit 3 and a row driver circuit 4 are associated with the display device 2. The display device 2 comprises pixels 8 which are arranged in rows n and column m. The rows n are selected via control lines 6. The row voltages $V_1$ to $V_4$ are supplied to the rows via these control lines. The column voltages $V_{col}$ are supplied to the columns m via data lines 7. The rows n of the display device are selected consecutively in principle. It is possible in special control methods to select the even rows only, for example in one screen traversal, and to control the odd rows in the next transversal. The invention is applicable to each and every control method, since it is not important in what sequence the rows are selected or controlled.

The row voltage $V_{row}$ lies in a range from V1=+14 V to V4=−12 V. The column voltage $V_{col}$ varies from $V_{colmin}$=0 V to $V_{colmax}$=5 V in dependence on the grey level to be displayed.

Figure 2:
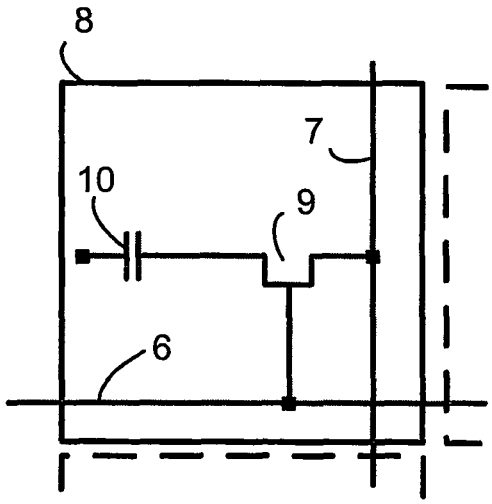
FIG. 2 is a circuit diagram of a pixel.

FIG. 2 shows a pixel 8. The pixel 8 mainly comprises a switching element 9, formed by a TFT transistor here. A storage capacitor 10 stores the charge until the next row sweep. The TFT transistor 9 is connected to the control line 6 and the data line 7. The row voltage $V_{row}$ is supplied through the control line 6. The gate of the TFT transistor 9 is opened or activated by this row voltage $V_{row}$. The row voltage opens the gates of all TFT transistors of the pixels present in this row. At the moment at which the gates of the TFT transistors are open, the column voltage $V_{col}$ is supplied via the data lines 7. All pixels present in the row are provided with their respective column voltages via the data lines 7, such that the pixels display the corresponding grey levels.

FIG. 3 is a diagram in which the switch-on pulses of the row voltage are shown for a passive matrix display. It is shown here that the row voltage of the selected row n is directly connected to the next row n+1 at a moment $t_{31}$. The charge of the row n flows to the row n+1 until a moment $t_{32}$. At this moment $t_{32}$, both transistors of both lines are open in the diagram of the row n+1, which may lead to a quality reduction in the case of active matrix displays. Starting from this moment, the line n+1 is charged further until the required charge level of $V_{row}$ has been reached.

FIG. 4 is a diagram of the present invention in which the switch-on pulses of the row voltage are shown for an active matrix display. At a moment $t_2$, the selected row n is connected to the intermediate voltage level $V_{colmax}$, and the charge is stored there. The row n remains connected to the intermediate voltage level $V_{colmax}$ up to a moment $t_3$. Then it is further discharged down to 0 V at moment $t_4$. The row n+1 is connected to the intermediate voltage level at a moment $t_5$, which is identical to the moment $t_4$. This row n+1 remains connected to the intermediate voltage level $V_{colmax}$ until moment $t_6$. Then it is charged up to the required voltage level of approximately 15 V by means of charge pumps. The energy saving here takes place in two steps. First the charge of the row n is stored at the intermediate voltage level $V_{colmax}$. It suffices for charging the row n+1 to charge the voltage difference between the intermediate voltage level $V_{colmax}$ and the necessary row voltage. The procedure is the same for the further rows.

The invention claimed is:

1. A method of controlling a passive matrix or an active matrix liquid crystal display device operating at a first display rate with pixels arranged in rows and columns, said method comprising:

supplying row voltages to the rows via control lines so as to select the rows;

supplying column voltages to the columns via data lines; selecting rows consecutively;

transferring a charge applied to a selected row n to a storage capacitor for only a first period of time and then subsequently transferring the charge remaining on the selected row to a reference potential in the case of a transition from the selected row n to another row n+1; and connecting the storage capacitor to the another row n+1 to transfer a charge to the another row n+1, and subsequently connecting the another row n+1 to a source for providing a required row voltage.

2. The method of claim 1 further comprising:

measuring an image repetition rate of the display device; and preventing the intermediate draining and the intermediate charging when the image repetition rate of the display device exceeds a threshold.

3. The method of claim 1 wherein transferring the charge to and from the storage capacitor is selectively terminated in response to selection of a second display rate.

4. A method of controlling an active matrix liquid crystal display device with pixels arranged in rows n and columns m, wherein row voltages are supplied to the rows via control lines so as to select said rows, and wherein column voltages are supplied to the columns m via data lines, and wherein the rows are consecutively selected, and in the case of a transition from a selected row n to another row n+1 the charge applied to the selected row n is transferred to an intermediate voltage level corresponding the column voltages supplied to the column for only a first period of time and then the charge remaining on the selected row is transferred to a reference potential, and the another row n+1 is first connected to the storage capacitor at a selected time after the end of the first period of time and is then subsequently connected to a source for providing a finally required row voltage.

5. The method of claim 4 wherein transferring the charge to and from the storage capacitor is selectively terminated in response to selection of a second display rate.

6. A display device comprising:

a thin film transistor (TFT) display having an array of a plurality of pixels arranged in rows and columns;

a row driver configured to selectively supply row voltages to the rows in the TFT display via control lines so as to select rows;

a column driver configured to supply column voltages to the columns in the TFT display via column data lines; and at least one storage capacitor disposed in a pixel of the plurality of pixels, wherein the at least one storage capacitor is configured to be couplable during a first line sweep when a row n is selected by the row driver to receive a charge applied from the column driver through at least one TFT transistor during the first line sweep and charge the at least one storage capacitor to an intermediate voltage level, and further configured to be connected to another row n+1 to transfer a charge on the at least one storage capacitor to the another row n+1 during a second line sweep subsequent to the first line sweep to bring the voltage of the another row n+1 to the intermediate voltage level; and wherein the row driver is further configured to bring the voltage level of the another row n+1 to a desired row voltage above the intermediate voltage level during the second line sweep.

7. The display device as defined in claim 6, wherein the TFT transistor is gated by voltage on row n supplied by the row driver during the first line sweep.

8. The display device as defined in claim 6, wherein charging of the at least one storage capacitor is selectably turned off when an image repetitions rate of the display device is above a predetermined level.

* * * * *